US005385026A

United States Patent [19]

Zhang et al.

[11] Patent Number: 5,385,026

[45] Date of Patent: Jan. 31, 1995

[54] APPARATUS FOR SUPPORTING A CRYOGENIC FLUID CONTAINMENT SYSTEM WITHIN AN ENCLOSURE

[75] Inventors: Burt X. Zhang, Lancaster; Venkatarao Ganni, Degoto; Kirk E. Stifle, Lancaster, all of Tex.

[73] Assignee: The United States of America as represented by the United States Department of Energy, Washington, D.C.

[21] Appl. No.: 27,063

[22] Filed: Mar. 4, 1993

[51] Int. Cl.[6] ..... F17C 13/00

[52] U.S. Cl. ..... 62/50.7; 62/51.1

[58] Field of Search ..... 62/50.7, 51.1; 138/12

[56] References Cited

U.S. PATENT DOCUMENTS

| | | | |
|---|---|---|---|
| 2,980,448 | 4/1961 | Holben | 62/50.7 X |
| 3,034,319 | 5/1962 | Chelton | 62/50.7 X |
| 3,383,875 | 5/1968 | Haas | 62/50.7 |
| 3,904,394 | 9/1975 | Prast et al. | 62/50.7 |
| 3,991,587 | 11/1976 | Laskaris | 62/50.7 |
| 3,992,169 | 11/1976 | Loudon | 62/50.7 |
| 4,011,732 | 3/1977 | Doherty et al. | 62/50.7 |
| 4,036,617 | 7/1977 | Leonard et al. | 62/50.7 |
| 4,036,618 | 7/1977 | Leonard et al. | 62/50.7 |
| 4,516,405 | 5/1985 | Laskaris | 62/50.7 |
| 4,696,169 | 9/1987 | Niemann et al. | 62/51.1 |
| 4,848,103 | 7/1989 | Pelc et al. | 62/51.1 |
| 4,878,351 | 11/1989 | Weber et al. | 62/51.1 |
| 5,032,869 | 7/1991 | Herd et al. | 62/51.1 X |
| 5,176,001 | 1/1993 | Taylor et al. | 62/51.1 X |

*Primary Examiner*—Christopher Kilner

*Attorney, Agent, or Firm*—Daniel D. Park; Hugh Glenn; William R. Moser

[57] ABSTRACT

An apparatus for supporting at least one inner cryogenic fluid containment system within an outer isolating enclosure to retard heat transfer into the inner containment system comprising a plurality of supports serially interconnected and laterally spaced by lateral connections to extend the heat conduction path into the inner containment system.

11 Claims, 7 Drawing Sheets

APPARATUS FOR SUPPORTING A CRYOGENIC FLUID CONTAINMENT SYSTEM WITHIN AN ENCLOSURE

CONTRACTURAL ORIGIN OF THE INVENTION

The United States Government has rights in this invention pursuant to Contract No. DE-AC02-89ER40486 between the U.S. Department of Energy and the Universities Research Association, Inc.

BACKGROUND OF THE INVENTION

The present invention relates to the transfer and storage of cryogenic fluids, and, more particularly, to cryogenic fluid transfer lines and storage vessels utilizing novel support means to increase their operating efficiency by reducing heat transfer into such systems.

The increasing use of cryogenic fluids in various scientific, medical, and technical fields has created the need for transfer lines and storage vessels with excellent thermal isolation characteristics for the efficient storage and transfer of these fluids. Because cryogenic fluids must be maintained at temperatures well below ambient, heat transfer, be it by radiation, conduction, or convection, into a cryogenic transfer line or storage system can result in loss of refrigeration which drives up operating costs and slows down fluid flow within the transfer line. The loss of refrigeration from heat transfer is amplified greatly by the power needed to recover such losses. For example, even with a cryogen recovery system, a heat transfer of 1 watt into a transfer line at 4K will take approximately 400 watts of electrical power to recover, provided that a very efficient refrigeration system with a Carnot efficiency of 30% is available. When a recovery system is not available, the penalty is even more severe, as the heat transfer is eventually translated into cryogen loss into the atmosphere.

In a typical cryogenic fluid transfer line wherein an inner fluid delivery tube is contained within an outer vacuum tube, or vessel, thermal insulation of the inner delivery tube is obtained by means of a vacuum which surrounds and separates the inner tube from the outer vacuum vessel. A major source of heat transfer into the inner delivery tube arises from the supports or spacers which align and suspend the inner tube within the outer vacuum vessel. Although there are various known configurations for the supports and spacers, the conventional design calls for thin circular disks, made from composite materials to be placed within the vacuum vessel to support and align the inner tube as it travels longitudinally in the vacuum vessel. Such support disks are then positioned at designated intervals along the transfer line to continuously align and support the inner delivery tube. However, such supports or spacers introduces considerable heat transfer, via conduction, into the inner cryogenic delivery tube.

The problem becomes even more acute when a plurality of delivery tubes of differing temperatures are enclosed within a common vacuum vessel and supported by a common disk. As is the case at the Superconducting Super Collider Laboratory and other facilities, various superconducting applications require that the cryogenic transfer line transport cryogen of various temperatures. In such applications, because a plurality of delivery tubes at differing temperatures share the same supporting disk, the inner delivery tubes are not only in thermal contact with the vacuum vessel but also with each other. Since the support disk tends to maintain a temperature warmer than the coolest delivery tube, heat conduction occurs directly from the support disk to the coldest delivery tube to create a very short heat conduction path. Accordingly steep temperature gradients are created within the support disk which intensify heat conduction into the transfer line.

Additionally, in applications utilizing a plurality of delivery tubes at different temperatures, an added difficulty arises from the thermal stress related to the expansion and contraction of the tubes. Since the support disk and the multiple delivery tubes have differing temperatures, their expansion/contraction rates vary and create thermally induced stresses between the various members in contact. Accordingly, the support disk, which experiences both longitudinal and radial stress from the delivery tubes, must be made thicker to absorb such stress, which, in turn, further aggravates the conductive heat transfer into the system.

Similarly, these same heat transfer and thermal stress considerations also apply to a standard cryogenic fluid storage vessel wherein an inner storage tank is suspended within an evacuated outer shell by various supporting means. Likewise, these problems become amplified when a storage vessel comprises a plurality of such inner tanks containing cryogen at different temperatures.

In view of the foregoing, the general object of this invention is to provide an apparatus for supporting an inner containment system within an outer enclosure to retard heat transfer into the inner containment system.

Another object of this invention is to provide an efficient cryogenic fluid transfer line utilizing novel support systems to retard heat transfer into the transfer line.

Yet another object of this invention is to provide a cryogenic fluid transfer line utilizing novel support systems to minimize thermally induced stress within the line.

A further object of this invention is to provide a storage vessel for cryogenic fluids utilizing a novel support system to reduce heat conduction into the vessel.

Additional objects, advantages and novel features of the invention will become apparent to those skilled in the art upon examination of the following and by practice of the invention.

SUMMARY OF THE INVENTION

To achieve the foregoing and other objects, this invention provides an apparatus for supporting at least one inner cryogenic fluid containment system within an outer isolating enclosure to retard heat transfer into the inner containment system by extending the heat conduction path. The support apparatus comprises two supporting means rigidly interconnected and laterally spaced at a predetermined distance by lateral connecting means which are sized to retard heat transfer between the supporting means. The first supporting means is adapted to be positioned outside the inner containment system in spaced outward relation to the inner containment system and includes outwardly extending positioning means at its outer periphery to align and retain the support apparatus within the outer enclosure. The second supporting means is adapted to support the inner containment system by means of inwardly extending fingers located at its inner periphery and is positioned in spaced inward relation to the outer enclosure. The inwardly extending fingers can be either rigidly secured to the inner containment system or be configured to engage the inner containment system in a fashion permitting it to slide freely within the fingers to allow for thermal expansion and contraction.

BRIEF DESCRIPTION OF THE DRAWINGS

The present invention is illustrated in the accompanying drawings where.

DESCRIPTION OF THE PREFERRED EMBODIMENT

Figure 1:
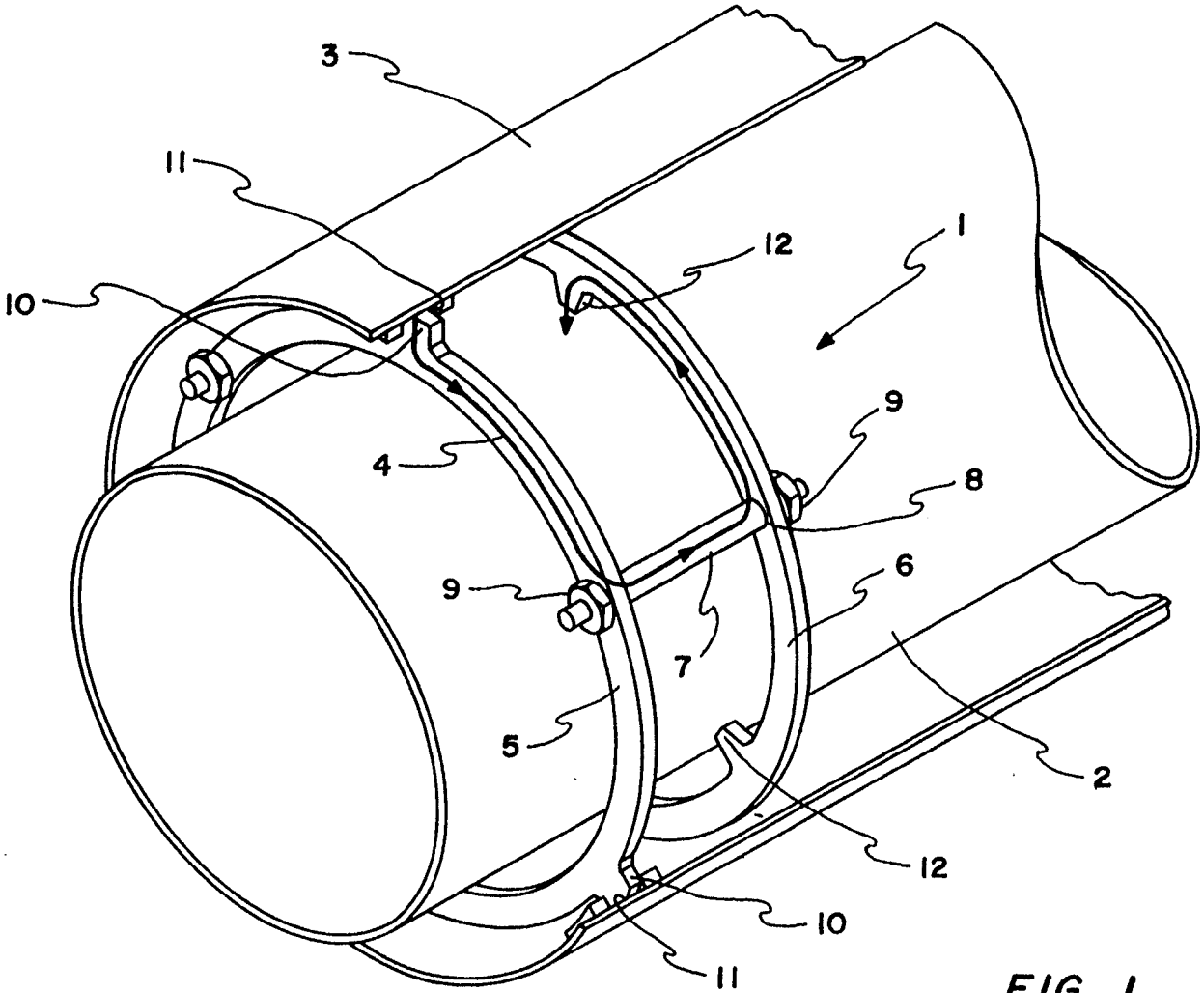
FIG. 1 is a partial cut-away view of a cryogenic fluid transfer line showing an apparatus embodying the invention supporting an inner vessel or tube within an outer enclosure to minimize heat transfer into the inner vessel.

As shown in FIG. 1, the embodiment of the invention in its simplest form provides a novel apparatus 1 for supporting an inner vessel or containment system 2 within an outer enclosure 3 to essentially minimize heat transfer into the inner containment system 2 by extending the heat conduction path 4 into the inner containment system 2. The support apparatus i comprises two supporting means or rings 5 and 6, respectively, rigidly interconnected and laterally spaced at a predetermined distance by means of slender stand-off rods 7 which are inserted through the rings via small holes 8 drilled through the width of the rings. The stand-off rods 7 are then secured to the rings 5 and 6 by nuts 9 or other suitable fastening means. The first ring 5 contains outwardly extending fingers 10 at its outer periphery to position the support apparatus i within the outer enclosure 3 by means of corresponding slots 11 located within the interior of the outer enclosure 3. The second ring 6, supports the inner containment system 2 by means of inwardly extending fingers 12 located at its inner periphery to suspend and align the inner containment system 2 within the outer enclosure 3. The inwardly extending fingers 12 can be either rigidly secured to the inner containment system 2 or configured to allow the inner containment system 2 to slide freely in the longitudinal direction within the fingers 12. For example, in a transfer or storage configuration wherein the inner containment system 2 is supported by a plurality of said support apparatus 1, only one such support apparatus 1 would be rigidly secured to the inner enclosure while the other support apparatus i would permit the inner containment system 2 to slide freely in the longitudinal direction to allow for thermal expansion and contraction. In this embodiment, the fingers 10 and 12 are narrow to minimize the area of thermal contact between the support apparatus 1 and the inner containment system 2 and the outer enclosure 3 to lengthen the heat conduction path 4 and reduce heat transfer into the inner containment system 2.

Figure 2:
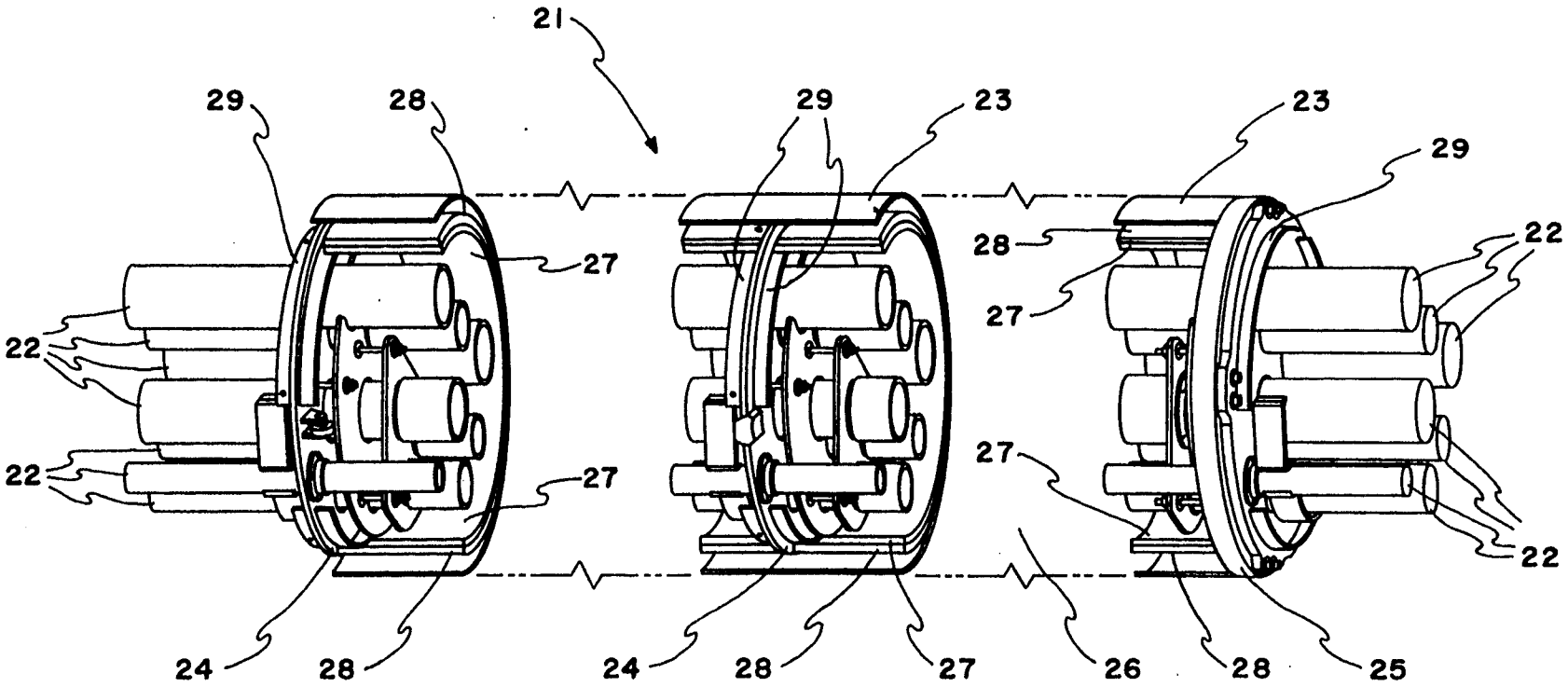
FIG. 2 is a partial cut-away view of a cryogenic fluid transfer line utilizing another embodiment of the invention including a plurality of novel radial and longitudinal support systems to align and suspend multiple inner delivery tubes within an outer tube.
Figure 3:
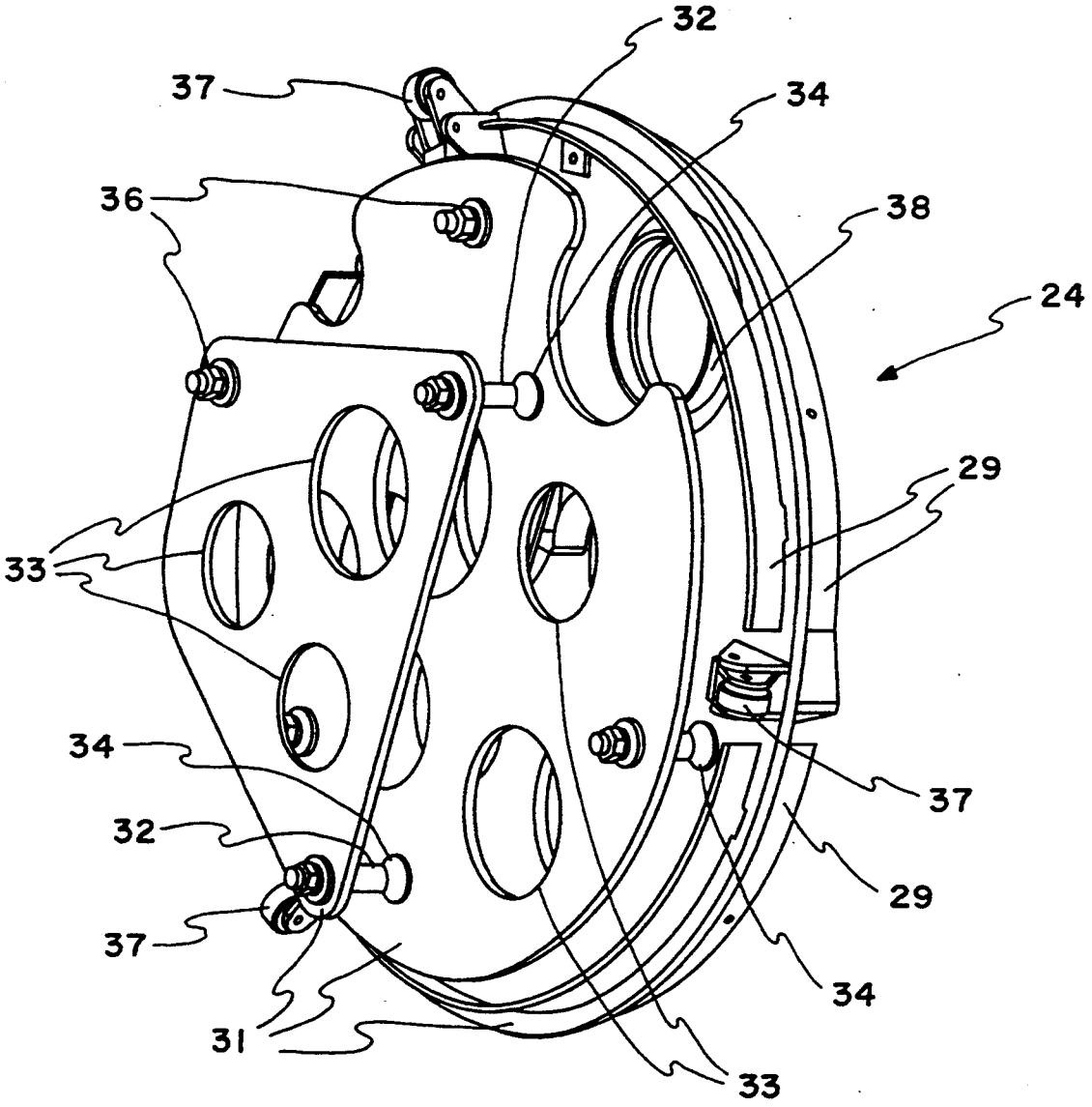
FIG. 3 is a pictorial view of the radial support system shown in FIG. 2.

The preferred embodiment of the invention in the cryogenic fluid transfer configuration is shown in FIGS. 2-6. FIG. 2, in particular, shows a partial cut-away drawing of the invention which provides a cryogenic fluid transfer line 21 comprising multiple fluid containment systems, or delivery tubes 22, suspended and secured within an evacuated outer enclosure or tube 23 by a plurality of radial and longitudinal support systems 24 and 25, respectively. The evacuated outer tube 23 is constructed of carbon steel pipe and encloses the inner fluid delivery tubes 22 such that a vacuum 26 surrounds the delivery tubes 22. The inner delivery tubes 22 are constructed of stainless steel and transport cryogenic fluids at different temperatures, namely liquid helium at 4K and 20K, and liquid nitrogen at 80K. The radial and longitudinal support systems 24 and 25 transmit the loading from the inner delivery tubes 22 to the outer tube 23 while aligning and suspending the delivery tubes 22 along essentially the central interior of the outer tube 23. In addition, an annular heat shield 27 and multilayer insulation (MLI) blanket 28 concentrically encircle the inner delivery tubes 22, being attached to and supported by the radial and longitudinal support systems 24 and 25 by thin arcuated brackets 29 mounted near the periphery of the support system, as shown in FIGS. 2 and 3. Preferably, the heat shield 27 is constructed of thin copper sheets and thermally anchored to the 80K liquid nitrogen delivery tubes 22. In this connection, it should be noted that the MLI blanket 28 overlaying the copper heat shield 27 comprises alternating layers of double aluminized mylar and spunbonded polyester spacer sheets.

Figure 4:
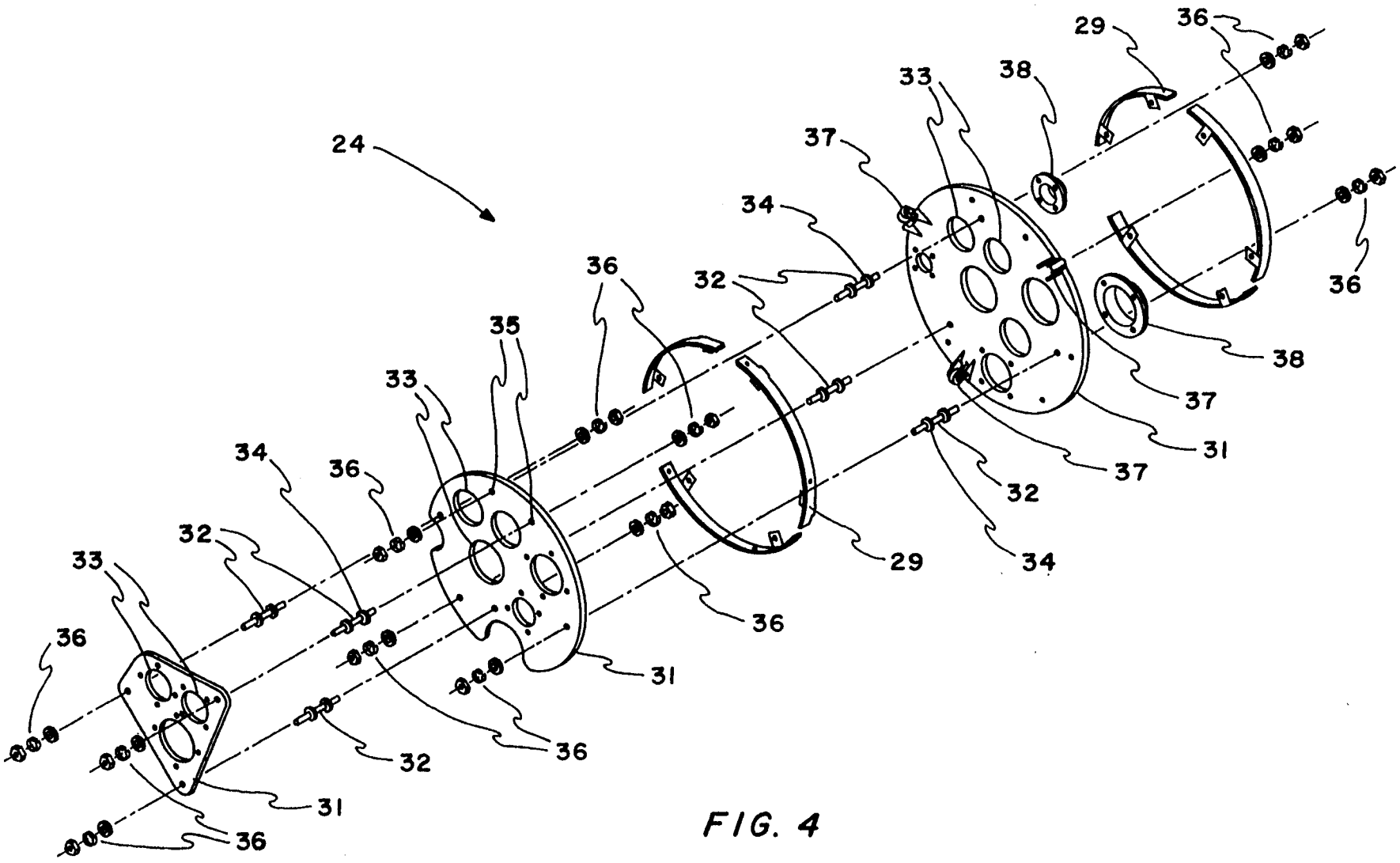
FIG. 4 is an exploded view of the radial support system shown in FIG. 3 detailing its component parts in relation to their positions.

In FIG. 3 and 4 is shown a radial support system 24 comprising a plurality of thin and generally circular supporting means or plates 31 interconnected and spaced by slender stand-off rods 32, and including circular holes 33 sized to receive, align and suspend the plurality of inner delivery tubes 22 longitudinally within the outer tube 23. The radial support system 24 described in the invention herein is comprised of three circular plates 31, with each plate serving respectively to support the inner delivery tubes 22 at temperatures of 4K, 20K, and 80K. The radial support system 24 is designed such that each plate 31 contacts only the delivery tubes 22 of the same temperature to achieve a minimum temperature gradient within the plate 31 to reduce any conductive heat transfer. As shown in FIGS. 2 and 3, the holes 33 contained within each plate 31 are aligned and sized such that each plate contacts only the delivery tubes 22 that it supports while allowing other unsupported tubes 22 to pass through without contact. For example, in the preferred embodiment, the 4K plate supports the delivery tubes at 4K but makes no contact with either the 20K or the 80K delivery tubes.

The plates 31, designated herein as 4K, 20K and 80K plates, are spaced and connected serially, via stand-off rods 32, from the warmest plate to the coolest plate, with only the warmest plate (80K) being then configured to transmit the loading to the outer tube 23, so as to lengthen the heat conduction path to the cooler delivery tubes. The stand-off rods 32, which are constructed of stainless steel, not only serve to lengthens the heat conduction path, but generally help to reduce heat conduction because of their small cross-sectional areas and because stainless steel is a poor conductor at cryogenic temperatures. Both ends of the stand-off rods 32 are threaded and include small circular shoulders 34 to space the plates at predetermined distances. The stand-off rods 32 are inserted through the plates by means of small holes 35 drilled through the plates and are secured by nuts and washers 36 applied from both ends. Although stainless steel provides sufficient rigidity and resistance to heat conduction, an excellent alternative material for the stand-off rods is inconel.

To minimize heat conduction, the plates 31 are normally constructed of composite materials such as nylon, Kel-F, a floropolymer manufactured by Accurate Plastics, Inc., Teflon or G-10/G-11, a glass epoxy also manufactured by Accurate Plastics, Inc. The plates 31 are then cut to shape from sheets or molded by injection or resin transfer molding. These composite materials while having excellent insulating characteristics also provide sufficient rigidity to properly support and align the inner delivery tubes 22. The plates 31 may also be constructed of stainless steel to achieve added structural rigidity if composite washers are used when connecting the plates 31 using stand-off rods 32. Additionally, the invention herein allows the use of thinner plates which further helps to reduce heat conduction and material costs. In the disclosed invention, because the several plates 31 are anchored to each other by means of stand-off rods 32 located near the periphery of the plates, the load from the centrally located delivery tubes 22 are redistributed towards the edges of the plates. As a result, the plates 31 can be made thinner than in a conventional design wherein all of the delivery tubes share a single support plate.

To minimize thermal expansion/contraction stresses, the radial support system 24 is positioned and retained within the outer tube 23 by means of rollers 37 attached to the 80K plate, as shown in FIGS. 3 and 4, such that the support system is free to shift longitudinally within the outer tube 23. Additionally, the radial support system 24 is secured only to the 80K delivery tubes, while the other delivery tubes (4K and 20K) are allowed to shift freely in the longitudinal direction through their respective supporting plates 31. The radial support system 24 is attached to the 80K delivery tubes by means of stainless steel collars 38, which are bolted to the 80K plate and welded to the 80K tubes. Consequently, the longitudinal thermal stress within the cryogenic fluid transfer line is minimized, as the radial support system 24 follows the thermal movements of the 80K delivery tubes while the other delivery tubes at different temperatures, and thus having differing expansion/contraction rates, are free to move within their respective plates 31. The design of the support system 24, as disclosed herein, also minimizes any radial thermal stress between the support system 24 and the supported delivery tubes 22, in that, since each plate 31 contacts only delivery tubes 22 of the same temperature and generally maintains that same temperature, any expansion/contraction differential between the plate 31 and the delivery tubes 22 are kept to a minimum.

Figure 5:
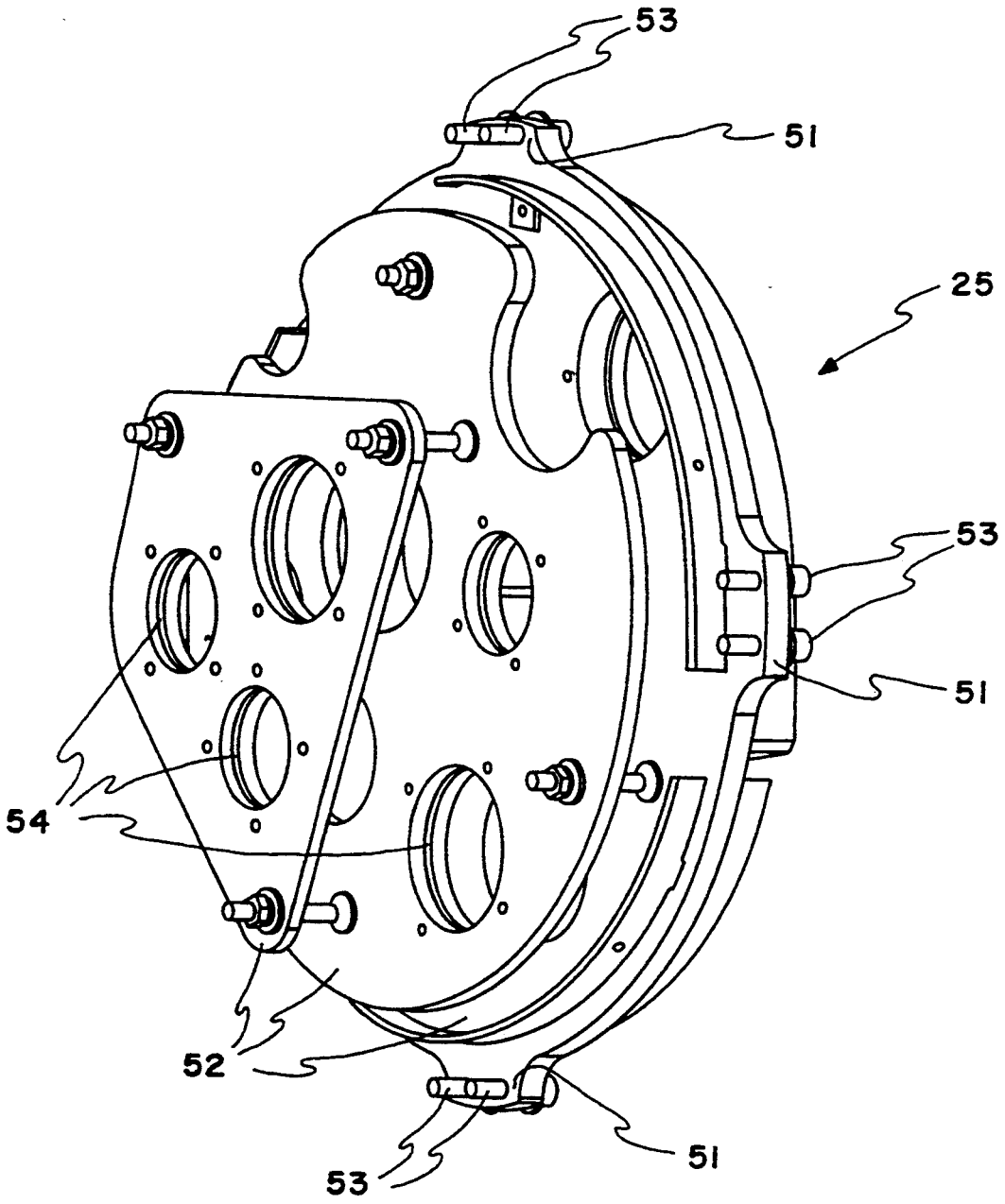
FIG. 5 is a pictorial view of the longitudinal support system shown in FIG. 2.
Figure 6:
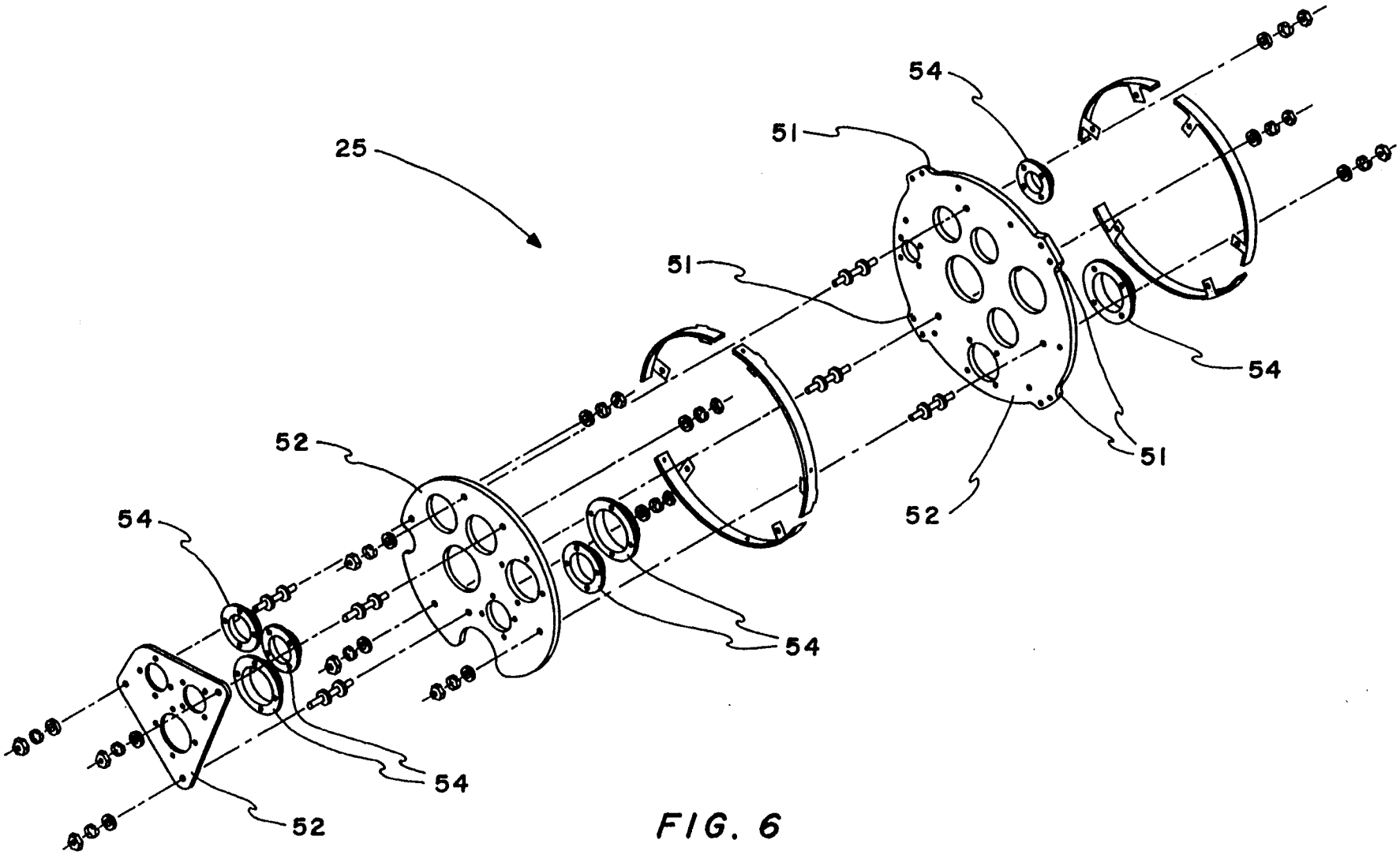
FIG. 6 is a exploded view of the longitudinal support system shown in FIG. 5.

Shown in FIG. 5 and 6 is a longitudinal support system 25 which anchors the delivery tubes 22 to one end of the outer tube 23 while providing longitudinal and radial support for the delivery tubes 22. Structurally, the longitudinal support system 25 is identical to the radial support system 24 except that instead of rollers 27 the 80K plate of the longitudinal support system 25 contains small extrusions, or fingers 51, about the outer periphery of the plate 52 to accommodate bolts 53 which secure the longitudinal support system 25 to the outer tube 23. Other minor structural differences include stainless steel collars 54 being bolted to each of the holes of the several plates 52 to secure and provide longitudinal support for all the inner delivery tubes 22. Also, the individual plates 51 are thicker than the plates 31 of the radial support system 24 to better support the additional longitudinal loading.

Figure 8:
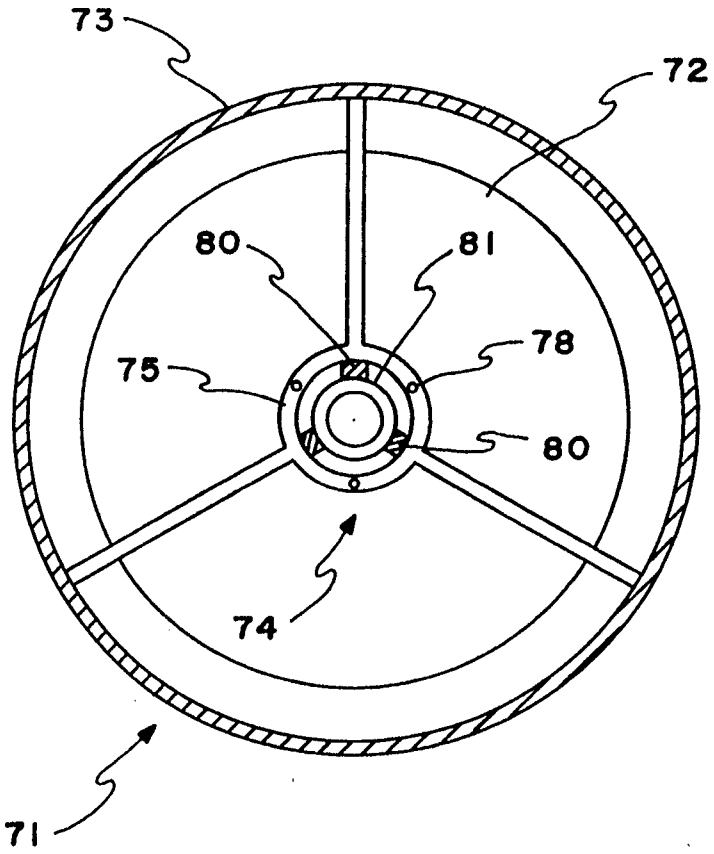
FIG. 8 is a cross-sectional end view of the storage vessel taken substantially along line 8—8 in FIG. 7 showing one end of the novel support system.
Figure 7:
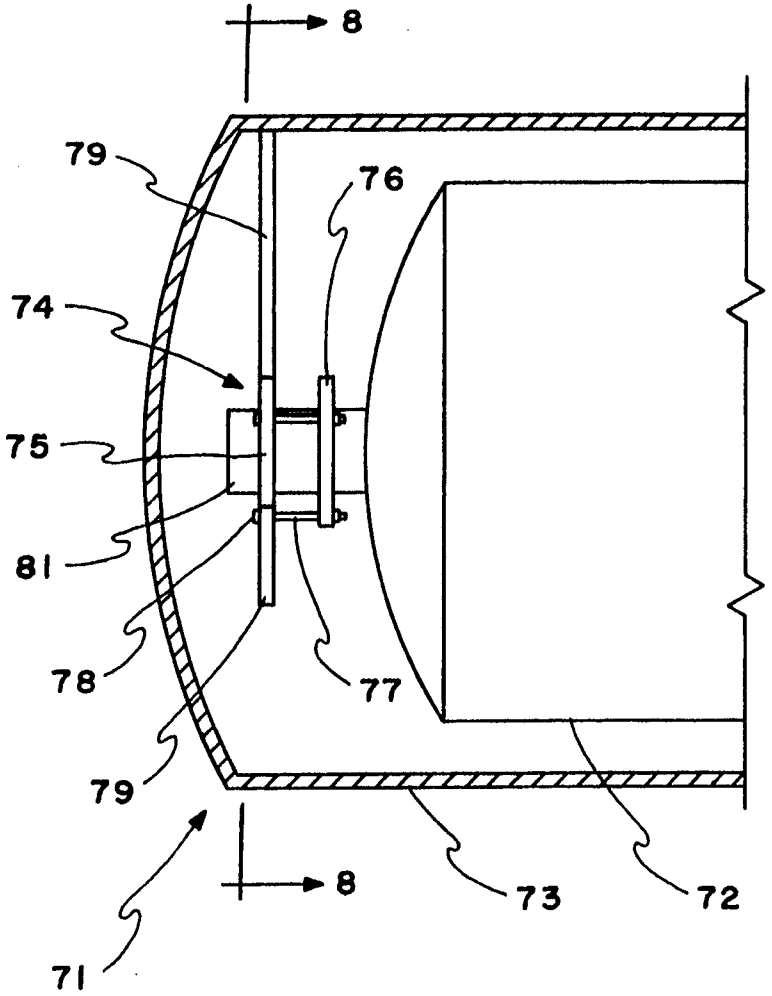
FIG. 7 is a cut-away side view of one end of a cryogenic fluid storage vessel utilizing another embodiment of the invention to suspend an inner cylindrical tank within an outer enclosure.

In addition to a cryogenic fluid transfer line, the invention discloses a storage vessel for cryogenic fluids which utilizes a novel support system to minimize heat transfer into the vessel. In FIGS. 7 and 8, wherein one end of a storage vessel is illustrated, is shown a storage vessel 71 comprising an inner cylindrical fluid storage tank 72 suspended within an evacuated outer cylindrical enclosure 73 by a novel support systems 74. The support system 74 comprises two circular supporting means, or rings 75 and 76, rigidly interconnected and laterally spaced at a predetermined distance by means of slender stand-off rods 77 which are inserted through the rings via small holes drilled through the width of the rings and secured by nuts 78. The first ring 75 contains outwardly projecting arms 79 at its outer periphery to secure the support system 74 to the outer enclosure 73. The second ring 76, supports the inner storage tank 72 by means of inwardly projecting extrusions 80 located along its inner periphery which hold and suspend a tubular extension 81 rigidly attached to the inner storage tank 72. In the storage vessel wherein the inner storage tank 72 is supported by a plurality of said support systems 74, only one such support system 74 would be rigidly secured to the tubular extension 81 of the inner tank while the other support systems 74 would permit the tubular extension 81 to slide freely in the longitudinal direction to allow for thermal expansion and contraction.

The material for constructing the support system 74 may include stainless steel, inconel (a nickel alloy), composite materials such as nylon, Kel-F, Teflon, or G-10/G-11 glass epoxy or any other such material as may provides the necessary physical stiffness while providing acceptable resistance to heat conduction.

The support system 74 is conceptually similar to the support systems disclosed above for the cryogenic fluid transfer line 21. By using a plurality of specially designed rings or disks, the support system 74 can easily be modified to support a plurality of inner cylindrical storage tanks, even tanks containing cryogenic fluids at various temperatures, in a fashion similar to that of the fluid transfer line 21 described above.

The foregoing description of the preferred embodiment of the invention has been presented for purposes of illustration and description. It is not intended to be exhaustive or to limit the invention to the precise form disclosed. For example, the novel support system for the cryogenic transfer line may comprise a number of plates greater than the three utilized in this invention. Also, additional plates may be added which do not support any delivery tubes but function to lengthen the total heat conduction path of the support system. The embodiment described herein explains the principles of the invention so that others skilled in the art may practice the invention in various embodiments and with various modifications as suited to the particular use contemplated. It is intended that the scope of the invention be defined by the claims appended hereto.

The embodiments of this invention in which an exclusive property or privilege is claimed are defined as follows:

1. An apparatus for supporting and aligning a plurality of cryogenic delivery tubes of a plurality of temperatures within an outer enclosure comprising:

first supporting means adapted to support at least one of said plurality of cryogenic delivery tubes;

second supporting means adapted to support the remaining said plurality of cryogenic delivery tubes not supported by the first supporting means;

said first supporting means being configured so as to be in spaced relation to the cryogenic delivery tubes supported by the second supporting means and selected to support only the cryogenic delivery tubes of essentially the same temperature;

said second supporting means being configured so as to be in spaced relation to the cryogenic delivery tubes supported by the first supporting means and selected to support only the cryogenic delivery tubes of essentially the same temperature;

lateral connecting means rigidly interconnecting said first and second supporting means in laterally spaced relation and being sized to retard heat transfer between said supporting means and positioned so as to extend the heat conduction path between the cryogenic delivery tubes and the outer enclosure; and positioning means attached to the first supporting means to align and retain said first supporting means within the outer enclosure.

2. The apparatus of claim 1 wherein said second supporting means includes a plurality of support members, said support members being serially secured to the first supporting means by said lateral connecting means, each said support member being adapted to support at least one of said plurality of cryogenic delivery tubes and configured so as to be in spaced relation to the respective cryogenic delivery tubes supported by the other support members and said first supporting means.

3. The apparatus of claim 1 wherein said second supporting means is rigidly secured to said supported cryogenic delivery tubes.

4. The apparatus of claim 1 wherein said second supporting means is adapted to slidably support said supported cryogenic delivery tubes.

5. The apparatus of claim 1 wherein said positioning means is adapted to be movable within said outer enclosure.

6. The apparatus of claim 1 wherein said positioning means is rigidly secured to said outer enclosure.

7. The apparatus of claim 1 wherein said first and second supporting means are constructed of a material selected from the group consisting of nylon, Kel-F, Teflon, G-10/G-11 composite, and stainless steel.

8. The apparatus of claim 1 and said outer enclosure evacuated of all gases such that a vacuum surrounds each said plurality of cryogenic delivery tubes.

9. A cryogenic fluid transfer line comprising a plurality of cryogenic delivery tubes of a plurality of temperatures suspended and aligned within an outer enclosure by a support apparatus adapted to retard heat transfer into said plurality of cryogenic delivery tubes comprising:

first supporting means adapted to support at least one of said plurality of cryogenic delivery tubes;

second supporting means adapted to support the remaining said plurality of cryogenic delivery tubes not supported by the first supporting means;

said first supporting means being configured so as to be in spaced relation to the cryogenic delivery tubes supported by the second supporting means and selected to support only the cryogenic delivery tubes of essentially the same temperature;

said second supporting means being configured so as to be in spaced relation to the cryogenic delivery tubes supported by the first supporting means and selected to support only the cryogenic delivery tubes of essentially the same temperature;

lateral connecting means rigidly interconnecting said first and second supporting means in laterally spaced relation and being sized to retard heat transfer between said supporting means and positioned so as to extend the heat conduction path between the cryogenic delivery tubes and the outer enclosure; and positioning means attached to the first supporting means to align and retain said first supporting means within the outer enclosure.

10. The cryogenic fluid transfer line of claim 9 wherein said second supporting means includes a plurality of support members, said support members being serially secured to the first supporting means by said lateral connecting means, each said support member being adapted to support at least one of said plurality of cryogenic delivery tubes and configured so as to be in spaced relation to the respective cryogenic delivery tubes supported by the other support members and said first supporting means.

11. An apparatus for supporting and aligning a plurality of cryogenic delivery tubes of a plurality of temperatures within an outer enclosure comprising:

first supporting means adapted to support at least one of said plurality of cryogenic delivery tubes;

second supporting means adapted to support at least one of said plurality of cryogenic delivery tubes not supported by said first supporting means;

third supporting means adapted to support the remaining said plurality of cryogenic delivery tubes not supported by the first supporting means and not supported by the second supporting means;

said first supporting means being configured so as to be in spaced relation to the cryogenic delivery tubes supported respectively by the second supporting means and the third supporting means and selected to support only the cryogenic delivery tubes of essentially the same temperature;

said second supporting means being configured so as to be in spaced relation to the cryogenic delivery tubes supported respectively by the first supporting means and the third supporting means and selected to support only the cryogenic delivery tubes of essentially the same temperature;

said third supporting means being configured so as to be in spaced relation to the cryogenic delivery tubes supported respectively by the first supporting means and the second supporting means and selected to support only the cryogenic delivery tubes of essentially the same temperature;

lateral connecting means rigidly interconnecting said first, second and third supporting means in laterally spaced relation and being sized to retard heat transfer between said supporting means and positioned so as to extend the heat conduction path between the cryogenic delivery tubes and the outer enclosure; and positioning means attached to the first supporting means to align and retain said first supporting means within the outer enclosure.

* * * * *